US009557760B1

(12) United States Patent
Tajalli

(10) Patent No.: US 9,557,760 B1
(45) Date of Patent: Jan. 31, 2017

(54) ENHANCED PHASE INTERPOLATION CIRCUIT

(71) Applicant: KANDOU LABS S.A., Lausanne (CH)

(72) Inventor: Armin Tajalli, Chavannes près Renens (CH)

(73) Assignee: KANDOU LABS, S.A. (CH)

( * ) Notice: Subject to any disclaimer, the term of this patent is extended or adjusted under 35 U.S.C. 154(b) by 0 days.

(21) Appl. No.: 14/925,686

(22) Filed: Oct. 28, 2015

(51) Int. Cl.
*G05F 3/26* (2006.01)

(52) U.S. Cl.
CPC ..... *G05F 3/262* (2013.01)

(58) Field of Classification Search
CPC ..... H03L 7/0814; H03L 7/07; H03L 7/0805; H03L 7/0998; H03L 7/0891; H03L 7/18; H03L 7/0816; H03L 7/081; G05F 3/262
USPC ..... 327/231, 237, 236, 243, 256
See application file for complete search history.

(56) References Cited

U.S. PATENT DOCUMENTS

| | | | |
|---|---|---|---|
| 3,196,351 | A | 7/1965 | Slepian |
| 3,636,463 | A | 1/1972 | Ongkiehong |
| 3,939,468 | A | 2/1976 | Mastin |
| 4,163,258 | A | 7/1979 | Ebihara |
| 4,181,967 | A | 1/1980 | Nash |
| 4,206,316 | A | 6/1980 | Burnsweig |
| 4,276,543 | A | 6/1981 | Miller |
| 4,486,739 | A | 12/1984 | Franaszek |
| 4,499,550 | A | 2/1985 | Ray, III |
| 4,722,084 | A | 1/1988 | Morton |
| 4,772,845 | A | 9/1988 | Scott |
| 4,774,498 | A | 9/1988 | Traa |
| 4,864,303 | A | 9/1989 | Ofek |
| 4,897,657 | A | 1/1990 | Brubaker |
| 4,974,211 | A | 11/1990 | Corl |
| 5,053,974 | A | 10/1991 | Penz |
| 5,166,956 | A | 11/1992 | Baltus |
| 5,168,509 | A | 12/1992 | Nakamura |
| 5,283,761 | A | 2/1994 | Gillingham |
| 5,287,305 | A | 2/1994 | Yoshida |
| 5,311,516 | A | 5/1994 | Kuznicki |

(Continued)

FOREIGN PATENT DOCUMENTS

| | | |
|---|---|---|
| CN | 101478286 | 7/2009 |
| EP | 2039221 | 2/2013 |

(Continued)

OTHER PUBLICATIONS

"Introduction to: Analog Computers and the DSPACE System," Course Material ECE 5230 Spring 2008, Utah State University, www.coursehero.com, 12 pages.

(Continued)

*Primary Examiner* — John Poos
(74) *Attorney, Agent, or Firm* — Invention Mine LLC

(57) ABSTRACT

A phase control circuit comprising a differential current generator having a differential output node configured to provide a differential drive current and a current conversion circuit connected to the differential output node configured to receive the differential drive current through saturated input Field-Effect Transistors (FETs), the saturated input FETs connected to triode mirroring FETs, the triode mirroring FETs configured to generate linearized current drive signals through first and second output drive nodes to drive a phase interpolator circuit.

20 Claims, 5 Drawing Sheets

(56) References Cited

U.S. PATENT DOCUMENTS

| | | | |
|---|---|---|---|
| 5,412,689 | A | 5/1995 | Chan |
| 5,449,895 | A | 9/1995 | Hecht |
| 5,459,465 | A | 10/1995 | Kagey |
| 5,511,119 | A | 4/1996 | Lechleider |
| 5,553,097 | A | 9/1996 | Dagher |
| 5,566,193 | A | 10/1996 | Cloonan |
| 5,599,550 | A | 2/1997 | Kohlruss |
| 5,659,353 | A | 8/1997 | Kostreski |
| 5,727,006 | A | 3/1998 | Dreyer |
| 5,802,356 | A | 9/1998 | Gaskins |
| 5,825,808 | A | 10/1998 | Hershey |
| 5,856,935 | A | 1/1999 | Moy |
| 5,875,202 | A | 2/1999 | Venters |
| 5,945,935 | A | 8/1999 | Kusumoto |
| 5,949,060 | A | 9/1999 | Schattschneider |
| 5,995,016 | A | 11/1999 | Perino |
| 5,999,016 | A | 12/1999 | McClintock |
| 6,005,895 | A | 12/1999 | Perino |
| 6,084,883 | A | 7/2000 | Norrell |
| 6,119,263 | A | 9/2000 | Mowbray |
| 6,172,634 | B1 | 1/2001 | Leonowich |
| 6,175,230 | B1 | 1/2001 | Hamblin |
| 6,232,908 | B1 | 5/2001 | Nakaigawa |
| 6,278,740 | B1 | 8/2001 | Nordyke |
| 6,346,907 | B1 | 2/2002 | Dacy |
| 6,359,931 | B1 | 3/2002 | Perino |
| 6,378,073 | B1 | 4/2002 | Davis |
| 6,398,359 | B1 | 6/2002 | Silverbrook |
| 6,404,820 | B1 | 6/2002 | Postol |
| 6,417,737 | B1 | 7/2002 | Moloudi |
| 6,452,420 | B1 | 9/2002 | Wong |
| 6,473,877 | B1 | 10/2002 | Sharma |
| 6,483,828 | B1 | 11/2002 | Balachandran |
| 6,504,875 | B2 | 1/2003 | Perino |
| 6,509,773 | B2 | 1/2003 | Buchwald |
| 6,556,628 | B1 | 4/2003 | Poulton |
| 6,563,382 | B1 | 5/2003 | Yang |
| 6,621,427 | B2 | 9/2003 | Greenstreet |
| 6,624,699 | B2 | 9/2003 | Yin |
| 6,650,638 | B1 | 11/2003 | Walker |
| 6,661,355 | B2 | 12/2003 | Cornelius |
| 6,766,342 | B2 | 7/2004 | Kechriotis |
| 6,839,429 | B1 | 1/2005 | Gaikwad |
| 6,839,587 | B2 | 1/2005 | Yonce |
| 6,865,234 | B1 | 3/2005 | Agazzi |
| 6,865,236 | B1 | 3/2005 | Terry |
| 6,954,492 | B1 | 10/2005 | Williams |
| 6,990,138 | B2 | 1/2006 | Bejjani |
| 6,999,516 | B1 | 2/2006 | Rajan |
| 7,023,817 | B2 | 4/2006 | Kuffner |
| 7,053,802 | B2 | 5/2006 | Cornelius |
| 7,085,153 | B2 | 8/2006 | Ferrant |
| 7,142,612 | B2 | 11/2006 | Horowitz |
| 7,142,865 | B2 | 11/2006 | Tsai |
| 7,167,019 | B2 | 1/2007 | Broyde |
| 7,180,949 | B2 | 2/2007 | Kleveland |
| 7,184,483 | B2 | 2/2007 | Rajan |
| 7,269,212 | B1 | 9/2007 | Chau |
| 7,335,976 | B2 | 2/2008 | Chen |
| 7,356,213 | B1 | 4/2008 | Cunningham |
| 7,358,869 | B1 | 4/2008 | Chiarulli |
| 7,362,130 | B2 | 4/2008 | Broyde |
| 7,389,333 | B2 | 6/2008 | Moore |
| 7,400,276 | B1 | 7/2008 | Sotiriadis |
| 7,428,273 | B2 | 9/2008 | Foster |
| 7,456,778 | B2 | 11/2008 | Werner |
| 7,462,956 | B2 | 12/2008 | Lan |
| 7,570,704 | B2 | 8/2009 | Nagarajan |
| 7,620,116 | B2 | 11/2009 | Bessios |
| 7,633,850 | B2 | 12/2009 | Ahn |
| 7,643,588 | B2 | 1/2010 | Visalli |
| 7,656,321 | B2 | 2/2010 | Wang |
| 7,697,915 | B2 | 4/2010 | Behzad |
| 7,706,524 | B2 | 4/2010 | Zerbe |
| 7,746,764 | B2 | 6/2010 | Rawlins |
| 7,787,572 | B2 | 8/2010 | Scharf |
| 7,841,909 | B2 | 11/2010 | Murray |
| 7,869,497 | B2 | 1/2011 | Benvenuto |
| 7,869,546 | B2 | 1/2011 | Tsai |
| 7,882,413 | B2 | 2/2011 | Chen |
| 7,899,653 | B2 | 3/2011 | Hollis |
| 7,933,770 | B2 | 4/2011 | Kruger |
| 8,064,535 | B2 | 11/2011 | Wiley |
| 8,091,006 | B2 | 1/2012 | Prasad |
| 8,106,806 | B2 | 1/2012 | Toyomura |
| 8,149,906 | B2 | 4/2012 | Saito |
| 8,159,375 | B2 | 4/2012 | Abbasfar |
| 8,159,376 | B2 | 4/2012 | Abbasfar |
| 8,185,807 | B2 | 5/2012 | Oh |
| 8,199,849 | B2 | 6/2012 | Oh |
| 8,218,670 | B2 | 7/2012 | AbouRjeily |
| 8,253,454 | B2 | 8/2012 | Lin |
| 8,279,094 | B2 | 10/2012 | Abbasfar |
| 8,295,250 | B2 | 10/2012 | Gorokhov |
| 8,310,389 | B1 | 11/2012 | Chui |
| 8,406,315 | B2 | 3/2013 | Tsai |
| 8,429,495 | B2 | 4/2013 | Przybylski |
| 8,442,099 | B1 | 5/2013 | Sederat |
| 8,442,210 | B2 | 5/2013 | Zerbe |
| 8,443,223 | B2 | 5/2013 | Abbasfar |
| 8,462,891 | B2 | 6/2013 | Kizer |
| 8,498,368 | B1 | 7/2013 | Husted |
| 8,520,493 | B2 | 8/2013 | Goulahsen |
| 8,547,272 | B2 | 10/2013 | Nestler |
| 8,578,246 | B2 | 11/2013 | Mittelholzer |
| 8,588,280 | B2 | 11/2013 | Oh |
| 8,593,305 | B1 | 11/2013 | Tajalli |
| 8,638,241 | B2 | 1/2014 | Sudhakaran |
| 8,649,840 | B2 | 2/2014 | Sheppard, Jr. |
| 8,718,184 | B1 | 5/2014 | Cronie |
| 8,780,687 | B2 | 7/2014 | Clausen |
| 8,782,578 | B2 | 7/2014 | Tell |
| 8,879,660 | B1 | 11/2014 | Peng |
| 8,949,693 | B2 | 2/2015 | Ordentlich |
| 8,951,072 | B2 | 2/2015 | Hashim |
| 8,989,317 | B1 | 3/2015 | Holden |
| 9,036,764 | B1 | 5/2015 | Hossain |
| 9,069,995 | B1 | 6/2015 | Cronie |
| 9,077,386 | B1 | 7/2015 | Holden |
| 9,093,791 | B2 | 7/2015 | Liang |
| 9,100,232 | B1 | 8/2015 | Hormati |
| 9,106,465 | B2 | 8/2015 | Walter |
| 9,281,785 | B2 | 3/2016 | Sjoland |
| 9,331,962 | B2 | 5/2016 | Lida |
| 9,362,974 | B2 | 6/2016 | Fox |
| 9,374,250 | B1 | 6/2016 | Musah |
| 2001/0006538 | A1 | 7/2001 | Simon |
| 2001/0055344 | A1 | 12/2001 | Lee |
| 2002/0034191 | A1 | 3/2002 | Shattil |
| 2002/0044316 | A1 | 4/2002 | Myers |
| 2002/0057592 | A1 | 5/2002 | Robb |
| 2002/0154633 | A1 | 10/2002 | Shin |
| 2002/0163881 | A1 | 11/2002 | Dhong |
| 2002/0174373 | A1 | 11/2002 | Chang |
| 2003/0048210 | A1 | 3/2003 | Kiehl |
| 2003/0071745 | A1 | 4/2003 | Greenstreet |
| 2003/0086366 | A1 | 5/2003 | Branlund |
| 2003/0105908 | A1 | 6/2003 | Perino |
| 2003/0146783 | A1 | 8/2003 | Bandy |
| 2003/0227841 | A1 | 12/2003 | Tateishi |
| 2004/0003336 | A1 | 1/2004 | Cypher |
| 2004/0003337 | A1 | 1/2004 | Cypher |
| 2004/0057525 | A1 | 3/2004 | Rajan |
| 2004/0086059 | A1 | 5/2004 | Eroz |
| 2004/0156432 | A1 | 8/2004 | Hidaka |
| 2004/0174373 | A1 | 9/2004 | Stevens |
| 2005/0057379 | A1 | 3/2005 | Jansson |
| 2005/0135182 | A1 | 6/2005 | Perino |
| 2005/0149833 | A1 | 7/2005 | Worley |
| 2005/0152385 | A1 | 7/2005 | Cioffi |
| 2005/0174841 | A1 | 8/2005 | Ho |
| 2005/0213686 | A1 | 9/2005 | Love |
| 2005/0286643 | A1 | 12/2005 | Ozawa |
| 2006/0018344 | A1 | 1/2006 | Pamarti |

(56) References Cited

U.S. PATENT DOCUMENTS

| | | | | |
|---|---|---|---|---|
| 2006/0115027 | A1 | 6/2006 | Srebranig | |
| 2006/0133538 | A1 | 6/2006 | Stojanovic | |
| 2006/0159005 | A1 | 7/2006 | Rawlins | |
| 2006/0269005 | A1 | 11/2006 | Laroia | |
| 2007/0030796 | A1 | 2/2007 | Green | |
| 2007/0188367 | A1 | 8/2007 | Yamada | |
| 2007/0260965 | A1 | 11/2007 | Schmidt | |
| 2007/0263711 | A1 | 11/2007 | Kramer | |
| 2007/0265533 | A1 | 11/2007 | Tran | |
| 2007/0283210 | A1 | 12/2007 | Prasad | |
| 2008/0104374 | A1 | 5/2008 | Mohamed | |
| 2008/0169846 | A1 | 7/2008 | Lan | |
| 2008/0273623 | A1 | 11/2008 | Chung | |
| 2008/0284524 | A1 | 11/2008 | Kushiyama | |
| 2009/0059782 | A1 | 3/2009 | Cole | |
| 2009/0092196 | A1 | 4/2009 | Okunev | |
| 2009/0132758 | A1 | 5/2009 | Jiang | |
| 2009/0154500 | A1 | 6/2009 | Diab | |
| 2009/0185636 | A1 | 7/2009 | Palotai | |
| 2009/0193159 | A1 | 7/2009 | Li | |
| 2009/0212861 | A1 | 8/2009 | Lim | |
| 2009/0257542 | A1 | 10/2009 | Evans | |
| 2010/0020898 | A1 | 1/2010 | Stojanovic | |
| 2010/0023838 | A1 | 1/2010 | Shen | |
| 2010/0046644 | A1 | 2/2010 | Mazet | |
| 2010/0104047 | A1 | 4/2010 | Chen | |
| 2010/0177816 | A1 | 7/2010 | Malipatil | |
| 2010/0180143 | A1 | 7/2010 | Ware | |
| 2010/0205506 | A1 | 8/2010 | Hara | |
| 2010/0296550 | A1 | 11/2010 | Rjeily | |
| 2010/0296556 | A1 | 11/2010 | Rave | |
| 2010/0309964 | A1 | 12/2010 | Oh | |
| 2011/0014865 | A1 | 1/2011 | Seo | |
| 2011/0051854 | A1 | 3/2011 | Kizer | |
| 2011/0072330 | A1 | 3/2011 | Kolze | |
| 2011/0084737 | A1 | 4/2011 | Oh | |
| 2011/0127990 | A1 | 6/2011 | Wilson | |
| 2011/0235501 | A1 | 9/2011 | Goulahsen | |
| 2011/0268225 | A1 | 11/2011 | Cronie | |
| 2011/0299555 | A1 | 12/2011 | Cronie | |
| 2011/0302478 | A1 | 12/2011 | Cronie | |
| 2011/0317559 | A1 | 12/2011 | Kern | |
| 2012/0063291 | A1 | 3/2012 | Hsueh | |
| 2012/0152901 | A1 | 6/2012 | Nagorny | |
| 2012/0161945 | A1 | 6/2012 | Single | |
| 2012/0213299 | A1 | 8/2012 | Cronie | |
| 2012/0257683 | A1 | 10/2012 | Schwager | |
| 2013/0010892 | A1 | 1/2013 | Cronie | |
| 2013/0051162 | A1 | 2/2013 | Amirkhany | |
| 2013/0088274 | A1* | 4/2013 | Gu | H03K 5/131 327/231 |
| 2013/0163126 | A1 | 6/2013 | Dong | |
| 2013/0259113 | A1 | 10/2013 | Kumar | |
| 2014/0016724 | A1 | 1/2014 | Cronie | |
| 2014/0119479 | A1* | 5/2014 | Tajalli | H03K 5/007 375/342 |
| 2014/0132331 | A1 | 5/2014 | Gonzalez Diaz | |
| 2014/0198837 | A1 | 7/2014 | Fox | |
| 2014/0226455 | A1 | 8/2014 | Schumacher | |
| 2014/0254730 | A1 | 9/2014 | Kim | |
| 2015/0010044 | A1 | 1/2015 | Zhang | |
| 2015/0078479 | A1 | 3/2015 | Whitby-Strevens | |
| 2015/0199543 | A1 | 7/2015 | Winoto | |
| 2015/0333940 | A1 | 11/2015 | Shokrollahi | |
| 2015/0381232 | A1 | 12/2015 | Ulrich | |
| 2016/0020796 | A1 | 1/2016 | Hormati | |
| 2016/0020824 | A1 | 1/2016 | Ulrich | |
| 2016/0036616 | A1 | 2/2016 | Holden | |

FOREIGN PATENT DOCUMENTS

| | | |
|---|---|---|
| JP | 2003163612 | 6/2003 |
| WO | 2009084121 | 7/2009 |
| WO | 2010031824 | 3/2010 |
| WO | 2011119359 | 9/2011 |

OTHER PUBLICATIONS

Abbasfar, A., "Generalized Differential Vector Signaling", IEEE International Conference on Communications, ICC '09, (Jun. 14, 2009), pp. 1-5.

Brown, L., et al., "V.92: the Last Dial-Up Modem?", IEEE Transactions on Communications, IEEE Service Center, Piscataway, NJ., USA, vol. 52, No. 1, Jan. 1, 2004, pp. 54-61. XP011106836, ISSN: 0090-6779, DOI: 10.1109/tcomm.2003.822168, pp. 55-59.

Burr, "Spherical Codes for M-ARY Code Shift Keying", University of York, Apr. 2, 1989, pp. 67-72, United Kingdom.

Cheng, W., "Memory Bus Encoding for Low Power: A Tutorial", Quality Electronic Design, IEEE, International Symposium on Mar. 26-28, 2001, pp. 199-204, Piscataway, NJ.

Clayton, P., "Introduction to Electromagnetic Compatibility", Wiley-Interscience, 2006.

Counts, L., et al., "One-Chip Slide Rule Works with Logs, Antilogs for Real-Time Processing," Analog Devices Computational Products 6, Reprinted from Electronic Design, May 2, 1985, 7 pages.

Dasilva et al., "Multicarrier Orthogonal CDMA Signals for Quasi-Synchronous Communication Systems", IEEE Journal on Selected Areas in Communications, vol. 12, No. 5 (Jun. 1, 1994), pp. 842-852.

Design Brief 208 Using the Anadigm Multiplier CAM, Copyright 2002 Anadigm, 6 pages.

Ericson, T., et al., "Spherical Codes Generated by Binary Partitions of Symmetric Pointsets", IEEE Transactions on Information Theory, vol. 41, No. 1, Jan. 1995, pp. 107-129.

Farzan, K., et al., "Coding Schemes for Chip-to-Chip Interconnect Applications", IEEE Transactions on Very Large Scale Integration (VLSI) Systems, vol. 14, No. 4, Apr. 2006, pp. 393-406.

Grahame, J., "Vintage Analog Computer Kits," posted on Aug. 25, 2006 in Classic Computing, 2 pages, http.//www.retrothing.com/2006/08/ classic_analog_.html.

Healey, A., et al., "A Comparison of 25 Gbps NRZ & PAM-4 Modulation used in Legacy & Premium Backplane Channels", DesignCon 2012, 16 pages.

International Search Report and Written Opinion for PCT/EP2011/059279 mailed Sep. 22, 2011.

International Search Report and Written Opinion for PCT/EP2011/074219 mailed Jul. 4, 2012.

International Search Report and Written Opinion for PCT/EP2012/052767 mailed May 11,2012.

International Search Report and Written Opinion for PCT/US14/052986 mailed Nov. 24, 2014.

International Search Report and Written Opinion from PCT/US2014/034220 mailed Aug. 21, 2014.

International Search Report and Written Opinion of the International Searching Authority, mailed Jul. 14, 2011 in International Patent Application S.N. PCT/EP2011/002170, 10 pages.

International Search Report and Written Opinion of the International Searching Authority, mailed Nov. 5, 2012, in International Patent Application S.N. PCT/EP2012/052767, 7 pages.

International Search Report for PCT/US2014/053563, dated Nov. 11, 2014, 2 pages.

Jiang, A., et al., "Rank Modulation for Flash Memories", IEEE Transactions of Information Theory, Jun. 2006, vol. 55, No. 6, pp. 2659-2673.

Loh, M., et al., "A 3×9 Gb/s Shared, All-Digital CDR for High-Speed, High-Density I/O" , Matthew Loh, IEEE Journal of Solid-State Circuits, Vo. 47, No. 3, Mar. 2012.

Notification of Transmittal of International Search Report and the Written Opinion of the International Searching Authority, for PCT/US2015/018363, mailed Jun. 18, 2015, 13 pages.

(56) References Cited

OTHER PUBLICATIONS

Notification of Transmittal of the International Search Report and the Written Opinion of the International Searching Authority, or the Declaration, dated Mar. 3, 2015, for PCT/ US2014/066893, 9 pages.
Notification of Transmittal of the International Search Report and the Written Opinion of the International Searching Authority, or the Declaration, for PCT/US2014/015840, dated May 20, 2014. 11 pages.
Notification of Transmittal of the International Search Report and the Written Opinion of the International Searching Authority, or the Declaration, for PCT/US2014/043965, dated Oct. 22, 2014, 10 pages.
Notification of Transmittal of the International Search Report and the Written Opinion of the International Searching Authority, or the Declaration, for PCT/US2015/039952, dated Sep. 23, 2015, 8 pages.
Notification of Transmittal of the International Search Report and the Written Opinion of the International Searching Authority, or the Declaration, for PCT/US2015/041161, dated Oct. 7, 2015, 8 pages.
Notification of Transmittal of the International Search Report and the Written Opinion of the International Searching Authority, or the Declaration, for PCT/US2015/043463, dated Oct. 16, 2015, 8 pages.
Notification of Transmittal of the International Search Report and the Written Opinion of the International Searching Authority, or the Declaration for PCT/EP2013/002681, dated Feb. 25, 2014, 15 pages.
Oh, et al., Pseudo-Differential Vector Signaling for Noise Reduction in Single-Ended Ended Signaling, DesignCon 2009.
Poulton, et al., "Multiwire Differential Signaling", UNC-CH Department of Computer Science Version 1.1, Aug. 6, 2003.
Schneider, J., et al., "ELEC301 Project: Building an Analog Computer," Dec. 19, 1999, 8 pages, http://www.clear.rice.edu/elec301/Projects99/anlgcomp/.
She et al., "A Framework of Cross-Layer Superposition Coded Multicast for Robust IPTV Services over WiMAX," IEEE Communications Society subject matter experts for publication in the WCNC 2008 proceedings, Mar. 31, 2008-Apr. 3, 2008, pp. 3139-3144.
Skliar et al., A Method for the Analysis of Signals: the Square-Wave Method, Mar. 2008, Revista de Matematica: Teoria y Aplicationes, pp. 109-129.
Slepian, D., "Premutation Modulation", IEEE, vol. 52, No. 3, Mar. 1965, pp. 228-236.
Tierney, J., et al., "A digital frequency synthesizer," Audio and Electroacoustics, IEEE Transactions, Mar. 1971, pp. 48-57, vol. 19, Issue 1, 1 page Abstract from http://ieeexplore.
Notification of Transmittal of the International Search Report and the Written Opinion of the International Searching Authority, or the Declaration, for PCT/US2015/037466, dated Nov. 19, 2015.
Stan, M., et al., "Bus-Invert Coding for Low-Power I/O, IEEE Transactions on Very Large Scale Integration (VLSI) Systems", vol. 3, No. 1, Mar. 1995, pp. 49-58.
Tallini, L., et al., "Transmission Time Analysis for the Parallel Asynchronous Communication Scheme", IEEE Transactions on Computers, vol. 52, No. 5, May 2003, pp. 558-571.
Wang et al., "Applying CDMA Technique to Network-on-Chip", IEEE Transactions on Very Large Scale Integration (VLSI) Systems, vol. 15, No. 10 (Oct. 1, 2007), pp. 1091-1100.
Zouhair Ben-Neticha et al, "The 'streTched-Golay and other codes for high-SNR finite-delay quantization of the Gaussian source at 1/2 Bit per sample", IEEE Transactions on Communications, vol. 38, No. 12 Dec. 1, 1990, pp. 2089-2093, XP000203339, ISSN: 0090-6678, DOI: 10.1109/26.64647.

* cited by examiner

ENHANCED PHASE INTERPOLATION CIRCUIT

BACKGROUND

Clocked digital communications systems often require timing signals which are offset in phase or delay from a known reference clock signal, either to provide an appropriate set-up or hold interval, or to compensate for propagation delay between the point of use and the location of the reference clock source. Systems relying on a single reference clock often utilize fixed or adjustable delay lines or delay circuits to generate a secondary clock signal which is time-offset from the original reference. As another example, a serial communications receiver may have a local clock synthesized from received data transitions, which must be phase-shifted an appropriate amount to allow its use in sampling the received data stream. Alternatively, systems providing a multi-phase reference clock, one example being a two-phase quadrature clock, may utilize phase interpolation techniques to generate a secondary clock signal intermediate to the two reference clock phases; in other words, having a phase offset interpolated between those of the reference clock phases.

Such phase interpolators also found extensive use in RF communications applications, as one example in producing an output signal having a particular phase relationship used to drive one element of a multi-element antenna array, such that the collection of element arrays driven by such output signals resulted in an output beam with the desired directional characteristics.

In one such application, two sinusoidal reference input signals having relative phase relationships of 90 degrees (thus commonly referred to as sine and cosine signals) are presented as inputs to the phase interpolator having an output W of:

$$W=A*\sin(\omega t)+(1-A)*\cos(\omega t) \quad \text{(Eqn. 1)}$$

where the control input A is varied between (in this example) 0 and 1 to set the relative phase of output W as compared to reference inputs sin(ωt) and cos(ωt). Following common practice in the art, this document will utilize this well-known phase interpolator nomenclature, without implying any limitation to two phase clocks, sinusoidal signals, single-quadrant versus multiple-quadrant operation, or a particular domain of applicability.

BRIEF DESCRIPTION

A known limitation of conventional phase interpolation circuits is the non-linear nature of the relationship between the phase control signal and the resultant phase offset of the output signal. As will be readily apparent to one familiar with the art, Eqn. 1 implies that the phase of result W varies as arctan $$\left(\frac{A}{1-A}\right),$$

which is linear near A=0.5 but significantly nonlinear as A decreases towards 0 or increases towards +1. In some applications, this non-linearity may simply be tolerated as an intractable source of clock jitter. In other applications, the non-linearity may be compensated by introduction of a correction function incorporated into operational generation of the controlling value A. Where such compensation cannot be performed, as one example where A is incrementally varied with the expectation of corresponding incremental phase adjustment to W, the nonlinearity complicates adjustment and, in the extreme case, may introduce operational instability in the resulting system.

An alternative phase interpolator is described, which utilizes the relationship $$W=\sqrt{A}*\sin(\omega t)+\sqrt{(1-A)}*\cos(\omega t) \quad \text{(Eqn. 2)}$$

in at least one mode of operation. As implied by Eqn. 2, the phase of W in this alternative varies as arcsin($\sqrt{A}$), which is approximately linear over a wider range of A between 0 and +1, as compared to a phase interpolator utilizing the relationship of Eqn. 1.

DETAILED DESCRIPTION

Figure 1:
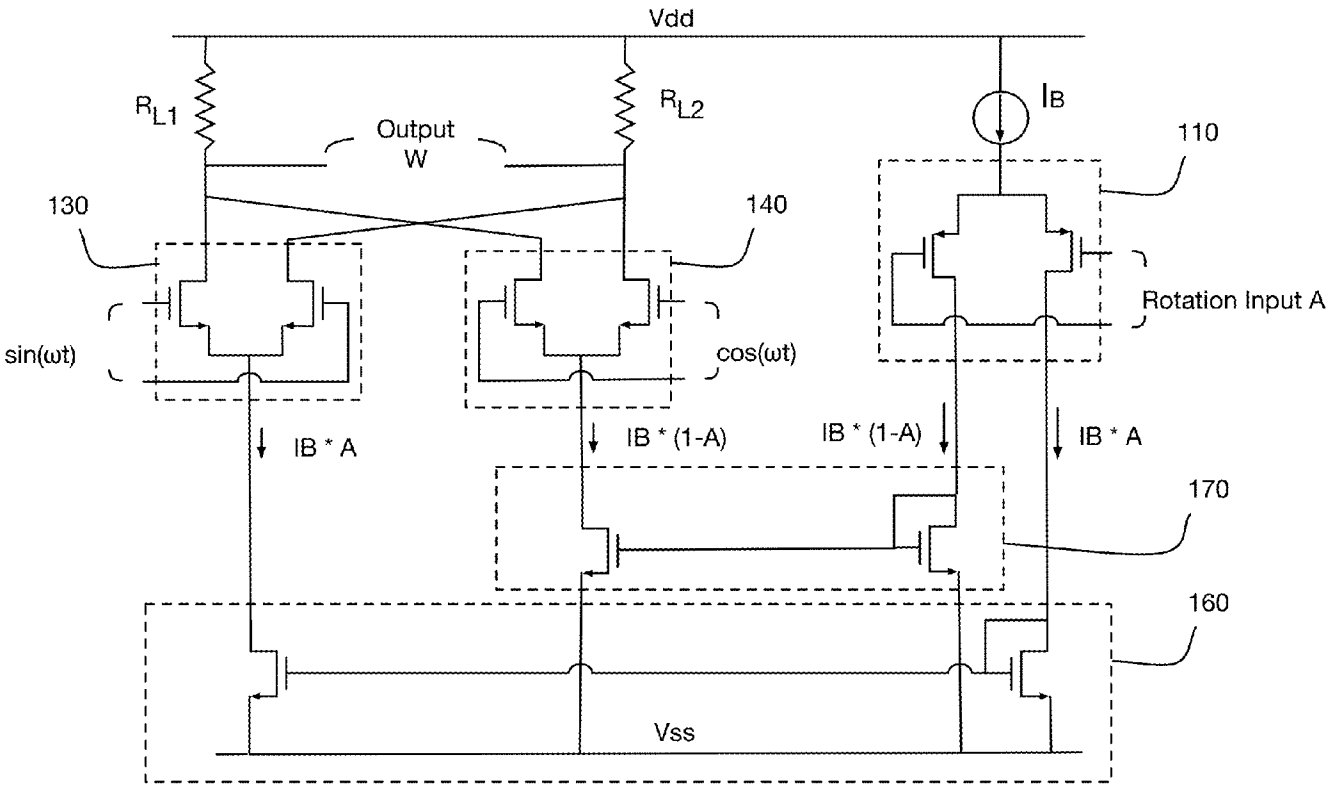
FIG. 1 (Prior Art)
FIG. 1 illustrates one example of a prior art phase interpolation circuit.

FIG. 1 illustrates one example of a prior art phase interpolator circuit suitable for embodiment in, as one example, a linear integrated circuit. It accepts sinusoidal reference clock inputs having a fixed quadrature phase relationship, identified as sin(ωt) and cos(ωt), as well as differential control signal inputs A and Á which select the relative phase of an output signal produced at differential output W, as described by Eqn. 1.

As will be well understood by one familiar with the art, the circuit of FIG. 1 utilizes differential transistor pair 110 to partition a fixed source current $I_B$ into two fractional currents $I_B$*A and $I_B$*(1−A) as directed by inputs A and Á, those fractional currents thus corresponding to the A and (1−A) factors of Eqn. 1. Fractional current $I_B$*A is mirrored by current mirror 160 to provide a current sink for differential pair 130, and fractional current $I_B$*(1−A) is mirrored by current mirror 170 to provide a current sink for differential pair 140. Reference clock signals sin(ωt) are input to 130, thus the current flow through 130 is a linear function of both $I_B$*A and sin(ωt). Similarly, reference clock signals cos (ωt) are input to 140, thus the current flow through 140 is a linear function of both $I_B$*(1−A) and cos(ωt). As differential transistor pairs 130 and 140 are connected in parallel to load resistors $R_{L1}$ and $R_{L2}$ across which differential output W is produced, output W is derived from the sum of the current flows through 130 and 140, thus representing a physical embodiment of the relationship described by Eqn. 1 above.

In one typical embodiment, output W includes a sinusoidal or approximately sinusoidal linear waveform having a phase relationship intermediate between those of the sin(ωt)

and cos(ωt) reference clock inputs, as controlled by A in the region 0≤A≤1. In a further embodiment, outputs W and Ẇ are digital waveforms comprising edge transitions having the described phase relationship, the digital output conversion occurring through the introduction such known functional element as a zero-crossing detector, digital comparator, or analog limiter, to convert the sinusoidal result of Eqn. 1 into a digital waveform.

A known limitation of this type of phase interpolation is the non-linear nature of the control relationship between the phase control signal value and the resultant phase offset of the output signal. As will be readily apparent to one familiar with the art, Eqn. 1 implies that the phase of result W varies as arctan $$\left(\frac{A}{1-A}\right),$$

which is linear near the center of its range (e.g. around A=0.5) but becomes significantly nonlinear as A moves towards its extremes. Thus, a system reliant on a phase interpolator of this type where the phase of W is approximately 45 degrees offset from both the sine and cosine reference clocks would experience relatively smooth and consistent incremental variation of such phase for small incremental adjustments of A. However, as A is adjusted further, the amount of phase change per incremental change of A will begin to deviate from that consistent behavior by a nonlinearly varying amount.

Interpolation Using Square Root Terms

Figure 4:
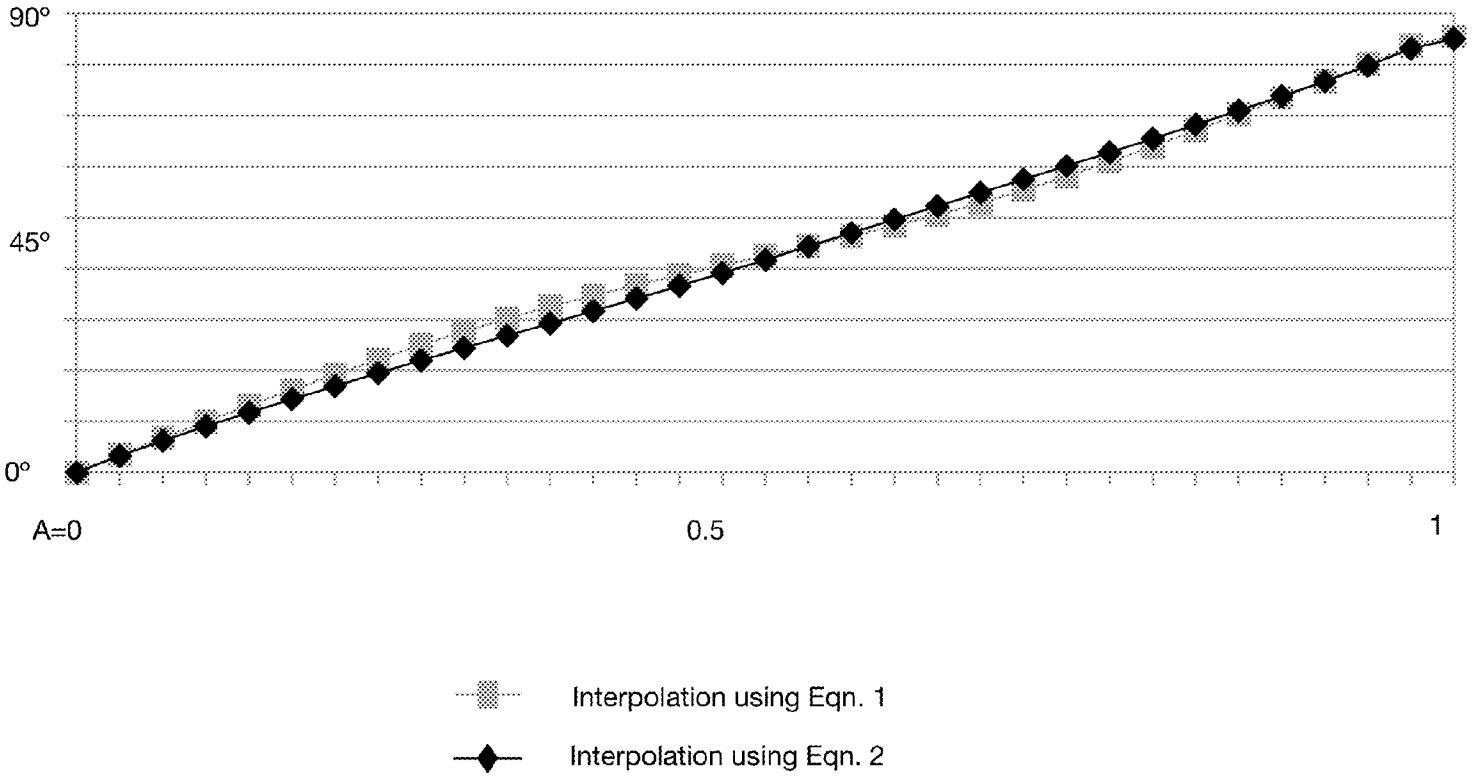
FIG. 4 is a graph showing the control transfer linearity of an embodiment compared to a prior art embodiment.

A new alternative to the phase interpolation method of Eqn. 1 utilizes differently computed weighting factors for the two quadrature clock terms to provide a more linear control term behavior. One embodiment of such an alternative phase interpolator utilizes the relationship $$W = \sqrt{A} * \sin(\omega t) + \sqrt{(1-A)} * \cos(\omega t) \qquad \text{(Eqn. 2, repeated)}$$

where A is again considered in the region 0≤A≤1. As implied by Eqn. 2, the phase of W in this alternative varies as arcsin($\sqrt{A}$), which is may be seen in the graph of FIG. 4 to be approximately linear over a wider range of A, as compared with the control relationship of the previous example.

Figure 2:
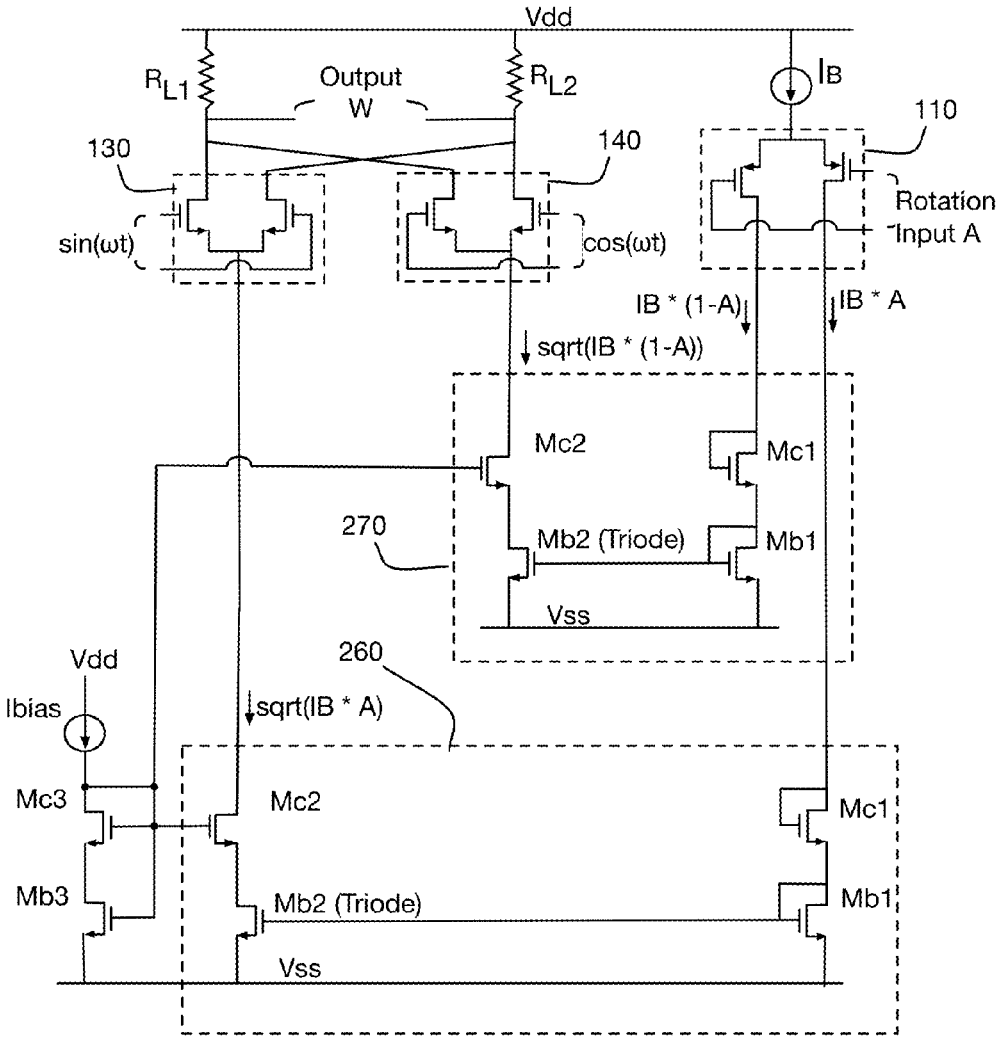
FIG. 2 is a schematic circuit diagram of one embodiment of a phase interpolator in accordance with an embodiment.

A first embodiment is shown in the circuit diagram of FIG. 2. Comparison of that circuit with the prior art example of FIG. 1 shows the square root terms of Eqn. 2 are implemented in FIG. 2 using function blocks 260 and 270 replacing conventional current mirrors 160 and 170 of FIG. 1. Function blocks 260 and 270 are modified current mirror circuits incorporating a combination of saturated and triode-mode (a.k.a. linear) current transistors. It is well understood that the normal saturated-mode behavior of a current mirror circuit may be modified through the introduction of devices operating in a linear or non-saturated mode, and thus exhibiting square law behavior. Function block 260 mirrors input current $I_B$*A by producing mirror current sqrt($I_B$*A), which sinks current from the sine differential pair 130. Similarly, function block 270 mirrors input current $I_B$*(1−A) by producing mirror current sqrt($I_B$*(1−A)), which sinks current from the cosine differential pair 140. These modifications result in the circuit of FIG. 2 behaving as a physical embodiment of the relationship described by Eqn. 2.

As shown, FIG. 2 includes a phase control circuit, including differential current generator 110, which has a differential output node configured to provide a differential drive current. FIG. 2 also has current conversion circuit including current mirrors 260 and 270, each current mirror having saturated input FETs Mc1 and Mb1 connected to the differential output node configured to receive the differential drive current, the saturated input FETs also connected to a triode-mirroring FET Mb2. Triode-mirroring FETs Mb2 are configured to generate linearized current drive signals through first and second output drive nodes. First and second phase driver circuits 130 and 140 of a phase interpolator are connected to the first and second output drive nodes, respectively, the first phase driver circuit 130 configured to receive a first phase of a reference signal (sin(wt)) and the second phase driver circuit 140 configured to receive a second phase of the reference signal (cos(wt)), the phase interpolator configured to generate a phase interpolated reference signal, W.

Current Mirror Circuits

Figure 3A:
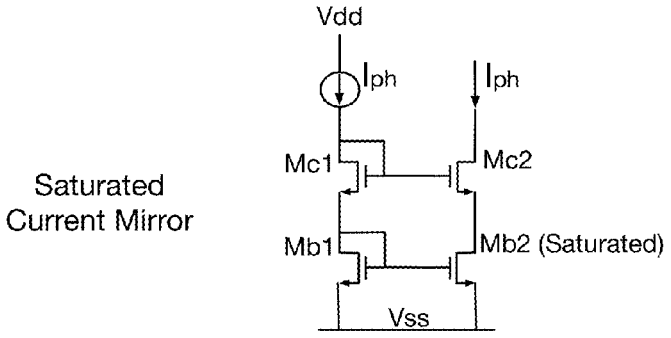
FIGS. 3A, 3B, and 3C illustrate a conventional saturated current mirror circuit, said circuit modified to produce a current having a square root relationship to the reference current, and a hybrid circuit providing a mixture of linear and square root-related currents related to the reference current, respectively.
Figure 3B:
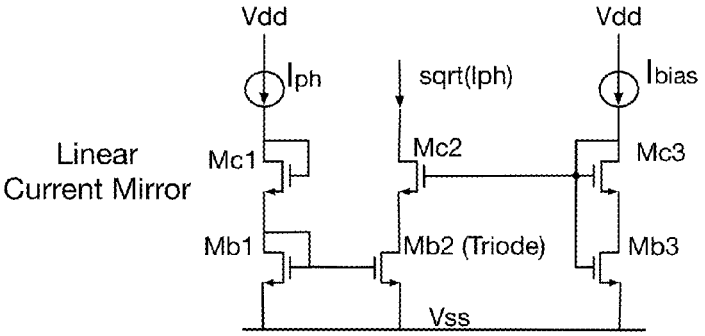
Figure 3C:
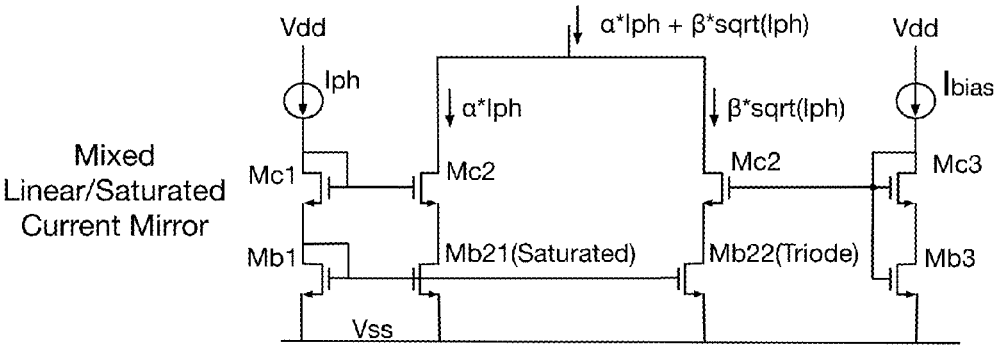

The analog computation used, as examples at 260 and 270 in the circuit of FIG. 2, are further illustrated in the three example embodiments shown in FIGS. 3A, 3B and 3C.

In the first embodiment of FIG. 3A, a saturated current mirror is shown producing a mirrored current flow Iph duplicating the source current flow Iph. It is well known that exact mirroring of the source current requires close matching of transistors Mc1 and Mc2, as well as Mb1 and Mb2. Conversely, the mirrored current may be scaled by a fixed factor by intentionally modifying transistor geometry; as one obvious example, doubling the channel width of Mc2 and Mb2 as compared to Mc1 and Mb1 also doubles the mirrored current, being equivalent to the addition of a parallel and identical current sink path.

In the second embodiment shown in FIG. 3B, a "linear" current mirror is shown, so-called as it incorporates a triode-connected current sink transistor (or triode-mirroring FET) operating in its linear or unsaturated mode, at Mb2. The square-law transfer characteristics of this transistor result is a mirrored current flow of sqrt(Iph) from source current Iph. The bias current Ibias is chosen to keep triode-mirroring FET Mb2 at an appropriate operating point to produce the desired behavior. In some embodiments, Ibias<Iph.

There are different ways to implement a current mirror in which the devices in the first stage are biased in strong inversion and the mirror transistor operates in triode (linear) region. The schematic diagram in FIG. 3B describes one possible implementation. In FIG. 3B, saturated-cascode FET Mb1, operating in strong inversion, carries the input current, and triode-mirroring FET Mb2 is the mirror device which is biased in triode region.

As Vgd(Mb1)=0, this device is working in saturation region. To put Mb2 in triode mode, it is necessary to have Vgd(Mb2)>Vth. Considering FIG. 3:

$$Vg(Mb2)=Vth+Vdsat(Mb1) \tag{1}$$

$$Vd(Mb2)=Vth+Vdsat(Mb3)-Vth-Vdsat(Mc2) \tag{2}$$

Hence:

$$Vgd(Mb2)=Vth+Vdsat(Mb1)-Vdsat(Mb3)+Vdsat(Mc2) \tag{3}$$

Properly choosing Ibias and the aspect ratio of Mb3, Mb1, and Mc2, it can be guaranteed that:

$$Vdsat(Mb1)-Vdsat(Mb3)+Vdsat(Mc2)>0 \tag{4}$$

and consequently:

$$Vgd(Mb2)>Vth \quad (5)$$

Therefore, Mb2 will operate in triode region.

The third embodiment of FIG. 3C illustrates a mixed linear and saturated current mirror, here producing a combined mirrored current of $(\alpha*Iph)+\beta(\sqrt{(Iph)})$ by combining both a saturated and a linear current mirror reflecting the same source current Iph. As previously described, transistor geometry within a current mirror may be modified so as to apply an additional scaling factor to a mirrored current, which are illustrated here by the multiplicative factors $\alpha$ and $\beta$, which allows the mixed current mirror design to be adapted to utilize different proportions of Eqn. 1 and Eqn. 2 behavior as desired. In one embodiment, all transistor geometries are identical, thus $\alpha=\beta=1$.

In other embodiments, a number of identical parallel transistors are provided in each of the saturated and/or linear current mirrors of the previous examples, with the number of transistors activated in each current mirror selectable electronically by driving unneeded transistors into cutoff via a secondary gate signal, allowing the ratios (e.g. the scaling factor of the first embodiment, or the values of $\alpha$ and $\beta$ of the third embodiment of FIG. 3C) to be changed. In an alternative embodiment, the channels of unneeded transistors are disconnected from the circuit via a separate series pass transistor.

It will be readily apparent to one of skill that other current mirror topologies known in the art may also be utilized in the described embodiments to equal result.

In some embodiments, an apparatus comprises a phase control circuit comprising, a differential current generator having a differential output node configured to provide a differential drive current, a current conversion circuit connected to the differential output node configured to receive the differential drive current through saturated input Field-Effect Transistors (FETs), the saturated input FETs connected to triode mirroring FETs, the triode mirroring FETs configured to generate linearized current drive signals through first and second output drive nodes, and, a phase interpolator circuit having a first phase driver circuit configured to receive a first phase of a reference signal, the first phase driver circuit connected to the first output drive node, and a second phase driver circuit configured to receive a second phase of the reference signal, the second phase driver circuit connected to the second output drive node, and configured to generate a phase interpolated reference signal.

In some embodiments, the phase interpolated reference signal represents a weighted sum of the first and second phases of the reference signal. In some embodiments, the first and second phases of the reference signal have weights determined by the linearized current drive signals.

In some embodiments, the current conversion circuit further comprises saturated-mirroring FETs configured to generate a portion of the linearized current drive signals. In some embodiments, the saturated-mirroring FETs are selectably enabled.

In some embodiments, the triode mirroring FETs are connected to saturated-cascode FETs, the saturated-cascode FETs are biased to force the triode-mirroring FETs into the triode region. In some embodiments, gate terminals of the saturated-cascode FETs are connected to a biasing circuit comprising a pair of gate-connected biasing FETs, one of the pair operating in saturation and the other of the pair operating in the triode region. In some embodiments, the biasing circuit further comprises a biasing current to bias the pair of gate-connected biasing FETs. In some embodiments, the biasing current is less than the differential drive current.

In some embodiments, the first phase and the second phase have a phase difference less than or equal to 90 degrees.

In some embodiments, the differential current generator is driven by a rotation input voltage signal.

Figure 5:
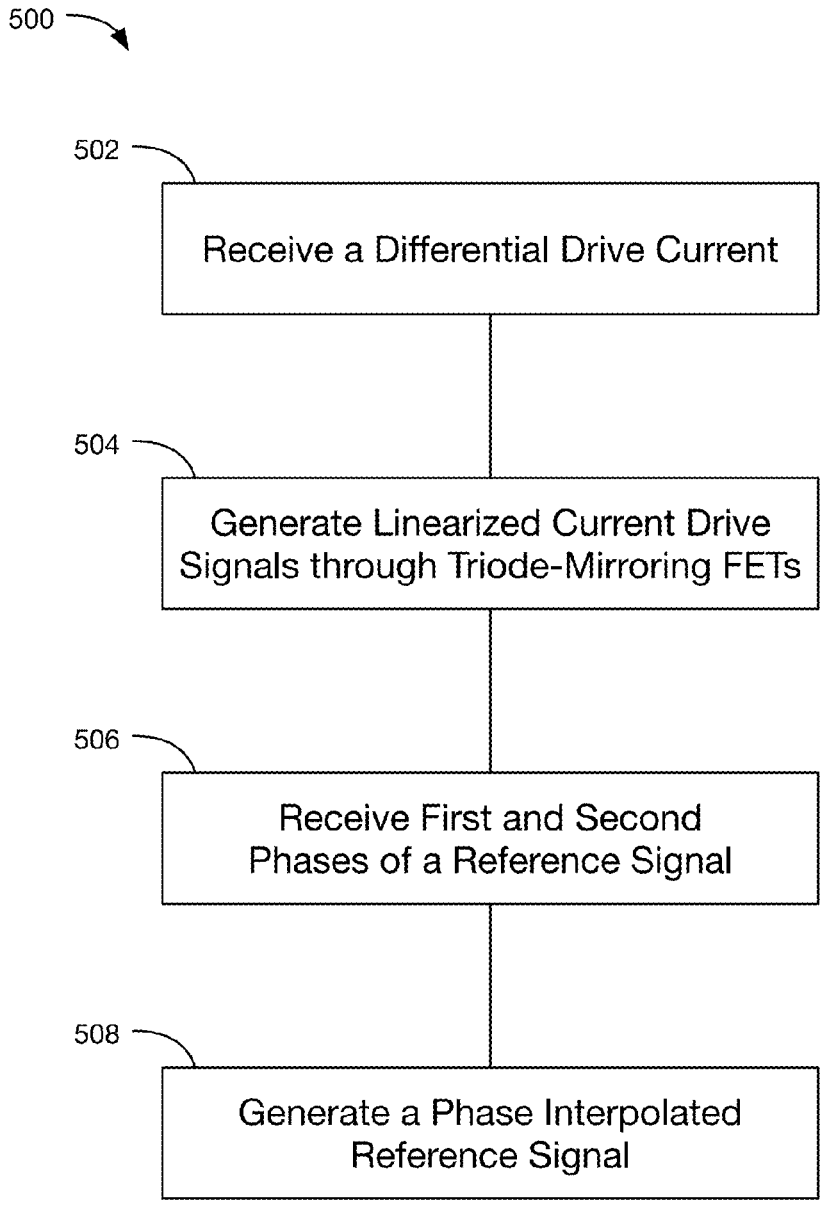
FIG. 5 is a flowchart of a process, in accordance with some embodiments.

FIG. 5 depicts a flowchart of a method 500, in accordance with some embodiments. As shown, method 500 includes the steps of receiving, at step 502, a differential drive current through saturated input Field-Effect Transistors (FETs), generating, at step 504, linearized current drive signals through triode mirroring FETs, the triode mirroring FETs connected to the saturated input FETs, receiving, at step 506, first and second phases of a reference signal, and generating, at step 508, using first and second phase driver circuits, a phase interpolated reference signal based on the received first and second phases of the reference signal and the linearized current drive signals.

In some embodiments, the phase interpolated reference signal represents a weighted sum of the first and second phases of the reference signal. In some further embodiments, the first and second phases of the reference signal have weights determined by the linearized current drive signals.

In some embodiments, a portion of the linearized current drive signals is generated using saturated-mirroring FETs. In further embodiments, the saturated-mirroring FETs are selectably enabled.

In some embodiments, the method further comprises biasing the triode-mirroring FETs into the triode region using saturated-cascode FETs connected to the triode mirroring FETs.

In some embodiments, the first phase and the second phase have a phase difference less than or equal to 90 degrees.

In some embodiments, the differential current generator is driven by a rotation input voltage signal.

In some embodiments, the phase interpolated reference signal has a waveform selected from the group consisting of: sinusoidal, approximately sinusoidal, a square wave, and a saw-tooth wave.

Waveform Effects

For clarity of explanation and consistency with past practice, the previous examples of phase interpolation have assumed the orthogonal reference clocks to be pure sinusoids, and to be orthogonally related in phase. However, other waveforms are equally applicable, and indeed may be more easily produced within a digital integrated circuit environment than pure sinusoids. As one example, pseudo-sinusoidal waveforms, i.e. those having predominantly sinusoidal characteristics but presenting some amount of residual waveform distortion or additional spectral content, often may be utilized in comparable manner to pure sinusoids.

It will be readily apparent to one familiar with the art that ideal square-risetime digital waveform clocks are not suitable reference inputs to the described forms of phase interpolator, as the summing characteristics of Eqn. 1 or Eqn. 2 will allow no distinguishable phase adjustment over a square-wave clock overlap period, obviating the usefulness of the circuit. However, in practical embodiments digital waveforms are not always ideal, and such "degraded" signals may be suitable for the described phase integration techniques. Examples of such degraded signals include digital waveforms having significant rise and fall times, including "rounded" square waves that have undergone significant high-frequency attenuation. Indeed, triangle waves in which the rise and fall times are comparable in duration to the quadrature clock overlap time are well known to be ideally suited for certain phase interpolation methods.

The relative control signal linearity of a phase interpolator operating on non-sinusoidal reference inputs will be dependent on both the actual signal waveforms and on the mixing algorithm used. Perfect triangle wave quadrature reference inputs, for example, are capable of producing completely linear control signal behavior with simple arithmetic summation (as described by Eqn. 1 and the Saturated circuit of FIG. 3A), while reference inputs having rounded (e.g. high frequency attenuated) or logarithmic (e.g. RC time constant constrained) rise times may show more linear control signal behavior with square root summation (as described by Eqn. 2 and the Linear circuit of FIG. 3B) or a mixture of linear and square root summation, such as produced by the mixed Saturated/Linear circuit of FIG. 3C.

In at least one embodiment, a mixed Saturated/Linear mirror circuit as shown in FIG. 3C is used within a phase interpolator circuit as in FIG. 2, wherein the "sine" and "cosine" reference inputs are "rounded" square wave signals having significant rise and fall duration throughout the quadrature overlap interval, and the $\alpha$ and $\beta$ scaling factors of the mirror circuit of FIG. 3C are fixed at time of design and manufacture. In another embodiment, additional parallel transistors are provided in both the saturated and linear current mirrors, allowing the $\alpha$ and $\beta$ scaling factors to be selected at time of initialization or operation by electronically disabling one or more of the additional parallel transistors. In a further embodiment, the current Ibias applied to the mirror circuit may be incrementally adjusted at time of system initialization or system operation, allowing incremental modification of the operating point of the current mirror transistors, and thus minor adjustment of the resulting mixed output behavior.

Similarly, any of the described embodiments may equally well be applied to produce an output result having an interpolated phase between two non-orthogonally-related inputs. As one example offered without limitation, the two clock inputs may have a 45 degree phase difference; in such cases the terms "sine" and "cosine" used herein should not be interpreted as limiting but instead as representing colloquial identifiers for such different-phased signals.

What is claimed is:

1. An apparatus comprising:

a phase control circuit comprising, a differential current generator having a differential output node configured to provide a differential drive current;

a current conversion circuit connected to the differential output node configured to receive the differential drive current through saturated input Field-Effect Transistors (FETs), the saturated input FETs connected to triode mirroring FETs, the triode mirroring FETs configured to generate linearized current drive signals through first and second output drive nodes; and, a phase interpolator circuit having a first phase driver circuit configured to receive a first phase of a reference signal, the first phase driver circuit connected to the first output drive node, and a second phase driver circuit configured to receive a second phase of the reference signal, the second phase driver circuit connected to the second output drive node, and configured to generate a phase interpolated reference signal.

2. The apparatus of claim 1, wherein the phase interpolated reference signal represents a weighted sum of the first and second phases of the reference signal.

3. The apparatus of claim 2, wherein the first and second phases of the reference signal have weights determined by the linearized current drive signals.

4. The apparatus of claim 1, wherein the current conversion circuit further comprises saturated-mirroring FETs configured to generate a portion of the linearized current drive signals.

5. The apparatus of claim 4, wherein the saturated-mirroring FETs are selectably enabled.

6. The apparatus of claim 1, wherein the triode mirroring FETs are connected to saturated-cascode FETs, the saturated-cascode FETs are biased to force the triode-mirroring FETs into the triode region.

7. The apparatus of claim 6, wherein gate terminals of the saturated-cascode FETs are connected to a biasing circuit comprising a pair of gate-connected biasing FETs, one of the pair operating in saturation and the other of the pair operating in the triode region.

8. The apparatus of claim 7, wherein the biasing circuit further comprises a biasing current to bias the pair of gate-connected biasing FETs.

9. The apparatus of claim 8, wherein the biasing current is less than the differential drive current.

10. The apparatus of claim 1, wherein the first phase and the second phase have a phase difference less than or equal to 90 degrees.

11. The apparatus of claim 1, wherein the differential current generator is driven by a rotation input voltage signal.

12. A method comprising:

receiving a differential drive current through saturated input Field-Effect Transistors (FETs);

generating linearized current drive signals through triode mirroring FETs, the triode mirroring FETs connected to the saturated input FETs;

receiving first and second phases of a reference signal; and generating, using first and second phase driver circuits, a phase interpolated reference signal based on the received first and second phases of the reference signal and the linearized current drive signals.

13. The method of claim 12, wherein the phase interpolated reference signal represents a weighted sum of the first and second phases of the reference signal.

14. The method of claim 13, wherein the first and second phases of the reference signal have weights determined by the linearized current drive signals.

15. The method of claim 12, wherein a portion of the linearized current drive signals is generated using saturated-mirroring FETs.

16. The method of claim 15, wherein the saturated-mirroring FETs are selectably enabled.

17. The method of claim 12, further comprising biasing the triode-mirroring FETs into the triode region using saturated-cascode FETs connected to the triode mirroring FETs.

18. The method of claim 12, wherein the first phase and the second phase have a phase difference less than or equal to 90 degrees.

19. The method of claim 12, wherein the differential current generator is driven by a rotation input voltage signal.

20. The method of claim 12, wherein the phase interpolated reference signal has a waveform selected from the group consisting of: sinusoidal, approximately sinusoidal, a square wave, and a saw-tooth wave.

* * * * *